US007178574B2

(12) United States Patent
Nielsen et al.

(10) Patent No.: US 7,178,574 B2
(45) **Date of Patent: *Feb. 20, 2007**

(54) LABELLING APPARATUS AND METHOD

(75) Inventors: Peter C. Nielsen, Leamington (CA); Joseph Z. Sleiman, Leamington (CA)

(73) Assignee: Ag-Tronic Control Systems Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/472,361

(22) PCT Filed: Jun. 14, 2002

(86) PCT No.: PCT/CA02/00907

§ 371 (c)(1),
(2), (4) Date: Sep. 22, 2003

(87) PCT Pub. No.: WO02/102669

PCT Pub. Date: Dec. 27, 2002

(65) Prior Publication Data

US 2004/0089423 A1 May 13, 2004

Related U.S. Application Data

(63) Continuation-in-part of application No. 09/883,244, filed on Jun. 19, 2001, now Pat. No. 6,729,375.

(51) Int. Cl.

| | |
|---|---|
| ***B65C 9/18*** | (2006.01) |
| ***B65C 9/26*** | (2006.01) |
| ***B65C 9/36*** | (2006.01) |
| ***B65C 9/42*** | (2006.01) |

(52) U.S. Cl. ..... 156/542; 156/361; 156/567; 156/568; 156/DIG. 33; 156/DIG. 37; 156/DIG. 42; 156/DIG. 45

(58) Field of Classification Search ..... 156/350, 156/361–363, 497, 538–542, 556–571
See application file for complete search history.

(56) References Cited

U.S. PATENT DOCUMENTS 2,569,101 A * 9/1951 Hoppe ..... 156/354

(Continued)

FOREIGN PATENT DOCUMENTS

DE 197 50 204 A1 5/1999

(Continued)

*Primary Examiner*—Melvin Mayes
(74) *Attorney, Agent, or Firm*—Warner Norcross & Judd LLP

(57) ABSTRACT

To label products on a conveyor, a target area for a given product conveyed on the conveyor is determined relative to a frame of reference. One of a plurality of labellers fixed at different transverse positions over the conveyor, which one labeller is at a transverse position which is within the transverse extent of the target area is then activated in order to label the product. Each labeller may have a turret with a number of flexible bellows with an interior air diffuser. The air diffuser has a central opening facing the tamping end of the bellows and at least one side opening. This arrangement can enhance the responsiveness of the bellows. Each labeller may also have a de-mountable label cassette with a drive pinion or geneva gear. The label cassette may have a driven pin wheel for moving the pin holed release tape of a label web.

20 Claims, 11 Drawing Sheets

U.S. PATENT DOCUMENTS

| | | | | |
|---|---|---|---|---|
| 2,745,665 | A | 5/1956 | Labombarde | 271/103 |
| 2,751,701 | A * | 6/1956 | Grupe | 156/238 |
| 4,369,085 | A | 1/1983 | Hermann | 156/384 |
| 4,411,393 | A | 10/1983 | Jodrey et al. | 242/75.43 |
| 4,547,252 | A | 10/1985 | LaMers | 156/497 |
| 4,648,930 | A | 3/1987 | La Mers | 156/247 |
| 4,813,355 | A | 3/1989 | Stork | 101/288 |
| 5,066,346 | A | 11/1991 | Long et al. | 156/157 |
| 5,645,680 | A | 7/1997 | Rietheimer | 156/567 |
| 5,738,755 | A | 4/1998 | Hartman | 156/566 |
| 5,829,351 | A | 11/1998 | Anderson et al. | 101/36 |
| 5,958,175 | A | 9/1999 | Elharrar et al. | 156/361 |
| 6,230,779 | B1 | 5/2001 | Anderson et al. | 156/567 |
| 6,257,294 | B1 | 7/2001 | Weisbeck | 156/356 |
| 6,321,812 | B1 | 11/2001 | Kral | 156/446 |
| 6,349,755 | B1 | 2/2002 | Sardo | 156/360 |
| 6,408,916 | B1 * | 6/2002 | Anderson et al. | 156/351 |
| 6,729,375 | B2 * | 5/2004 | Nielsen et al. | 156/362 |
| 2005/0109443 | A1 * | 5/2005 | Sleiman et al. | 156/64 |
| 2005/0161164 | A1 * | 7/2005 | Sleiman et al. | 156/539 |

FOREIGN PATENT DOCUMENTS

| | | | |
|---|---|---|---|
| DE | 198 32 548 | A1 | 1/2000 |
| EP | 0113256 | | 4/1999 |
| EP | 1044884 | | 10/2000 |
| FR | 2719020 | A1 | 10/1995 |
| FR | 2 719 283-1 | A | 11/1995 |
| FR | 2 725 955 | A1 | 4/1996 |
| FR | 2 796 143 | A1 | 1/2001 |
| GB | 659264 | | 10/1951 |
| WO | WO 99/46170 | | 9/1999 |
| WO | WO 00/58157 | | 10/2000 |
| WO | WO 2005042350 | A2 * | 5/2005 |

* cited by examiner

LABELLING APPARATUS AND METHOD

CROSS-REFERENCE TO RELATED APPLICATION

This is a continuation-in-part application of application Ser. No. 09/883,244 filed Jun. 19, 2001 now U.S. Pat. No. 6,729,375 entitled "LABELLING APPARATUS AND METHOD", the contents of which are incorporated by reference herein.

BACKGROUND OF THE INVENTION

The present invention relates to a method and apparatus for labelling products.

Products to be sold are commonly labelled. In this regard, automatic labelling apparatus may be employed where the products are smaller and processed in large volumes. One approach in this regard is to wipe a label onto each product as its passes a labelling head. This approach, however, is only well suited for labelling products of uniform dimensions. Where products have irregular dimensions, such that the distance between a given product and the labelling head will vary, tamping labellers are typically used. U.S. Pat. No. 5,829,351 to Anderson discloses such a labeller. In Anderson, a turret carries a number of flexible pneumatic bellows about its periphery. The turret has a vacuum plenum and a positive pressure plenum. The turret rotates each bellows, consecutively, to a labelling station. A bellows normally communicates with the vacuum plenum which keeps it in a retracted position; also, due to end perforations in the bellows, the negative pressure holds a label at the end of the bellows. However, when the bellows reaches the labelling station, it is coupled to the positive pressure plenum which causes a one-way valve to block the perforations and causes the bellows to rapidly extend until it tamps a product below. The force of the tamping forms an adhesive bond between the pressure sensitive adhesive of the label and the product. Labels are fed to each bellows from a label cassette with a label web comprising serially arranged labels on a release tape. The release tape is split along a weakened centreline to release the labels.

A problem arises if products are irregularly arranged such that they do not all pass directly below the labelling station. A further difficulty faced by a tamping apparatus employing a flexible bellows is in the accurate control of tamping with the bellows. Another difficulty is in the synchronisation of the label web with the bellows and in the ease of re-loading a label cassette. It can also be problematic to consistently transfer a label to a flexible bellows. This invention seeks to address at least some of these problems.

SUMMARY OF INVENTION

In one aspect, a target area for a given product conveyed on a conveyor is determined relative to a frame of reference. One of a plurality of labellers fixed at different transverse positions over the conveyor, which one labeller is at a transverse position which is within the transverse extent of the target area is then activated in order to label the product. In another aspect, a labeller has a flexible bellows with an interior air diffuser. The air diffuser has a central opening facing the tamping end of the bellows and at least one side opening. This arrangement can enhance the responsiveness of the bellows. In a further aspect, a labeller has a two-sided timing belt driven by a stepper motor with a de-mountable label cassette which, when mounted, has a drive pinion meshing with the two-sided timing belt. Alternatively, the de-mountable cassette has a geneva gear that is advanced by a protuberanced wheel on the base of the labeller. In another aspect, a labeller has a label cassette with a driven pin wheel for moving a pin holed release tape of a label web.

Accordingly, the present invention provides labelling apparatus for use with a conveyor for conveying products in a downstream direction, comprising: a vision system for imaging products on said conveyor; a plurality of labellers downstream of said vision system, each labeller for being fixed above said conveyor at a different transverse position over said conveyor; a processor for, responsive to an input from said vision system, selecting a labeller to label a given product and sending an activation signal to one said labeller.

According to another aspect of the invention, there is provided a method of labelling products, comprising conveying products in a downstream direction, determining a target area for a given product on the conveyor relative to a frame of reference, and activating a one of a plurality of labellers positioned above the conveyor at fixed transverse positions which one labeller is within a transverse extent of the target area. A computer readable medium is also provided to effect this method.

According to a further aspect of the present invention, there is provided a product labelling apparatus comprising: at least one flexible bellows having a retracted position and an extended tamping position; an air diffuser associated with each bellows, each air diffuser extending interiorly of an associated bellows from a base of said associated bellows toward a tamping end of said associated bellows, said each air diffuser having a central opening facing said tamping end of said associated bellows and at least one side opening facing a side of said associated bellows.

According to another aspect of the invention, there is provided a labelling apparatus comprising: an indexing turret carrying a plurality of tamping labellers; a stepper motor for stepping in synchronism with step-wise movement of said turret, said stepper motor for driving a two-sided timing belt; a releasable mount for a label web cassette; said label web cassette having a drive pinion, said drive pinion for meshingly engaging with said two-sided timing belt when said label web cassette is mounted to said releasable mount.

According to a further aspect of the invention, there is provided a labelling apparatus comprising: an indexing turret carrying a plurality of tamping labellers; a label web cassette normally driven in synchronism with said indexing turret; wherein a label web of said cassette has a pin hole between each label and wherein said label web cassette has a driven pin wheel engaging said pin holes; and a ratchet tooth fixed in relation to a pin of said pin wheel and a pawl setting a limit for driving said label web cassette in a label web retracting direction whereby said label web may be retracted so that a label is at a pre-determined start position.

According to another aspect of the present invention, there is provided a labelling apparatus comprising: a turret carrying a plurality of tamping labellers; a protuberanced wheel having at least one protuberance; an intermittent drive for intermittently driving said turret and said protuberanced wheel; a slotted wheel driven by said protuberanced wheel, said slotted wheel for driving a label web for feeding labels to said tamping labellers.

According a further aspect of the invention, there is provided a labelling apparatus comprising: a turret carrying a plurality of flexible tamping bellows; a pin wheel; an intermittent drive for intermittently driving said turret and said pin wheel; a label web for feeding labels to said tamping labellers; a slotted wheel driven by said pin wheel, said slotted wheel for driving said label web.

Other aspects and features of the invention will become apparent be reference to the following description in conjunction with the drawings.

BRIEF DESCRIPTION OF THE DRAWINGS

In the figures which set out example embodiments of the invention.

DETAILED DESCRIPTION

Figure 1:
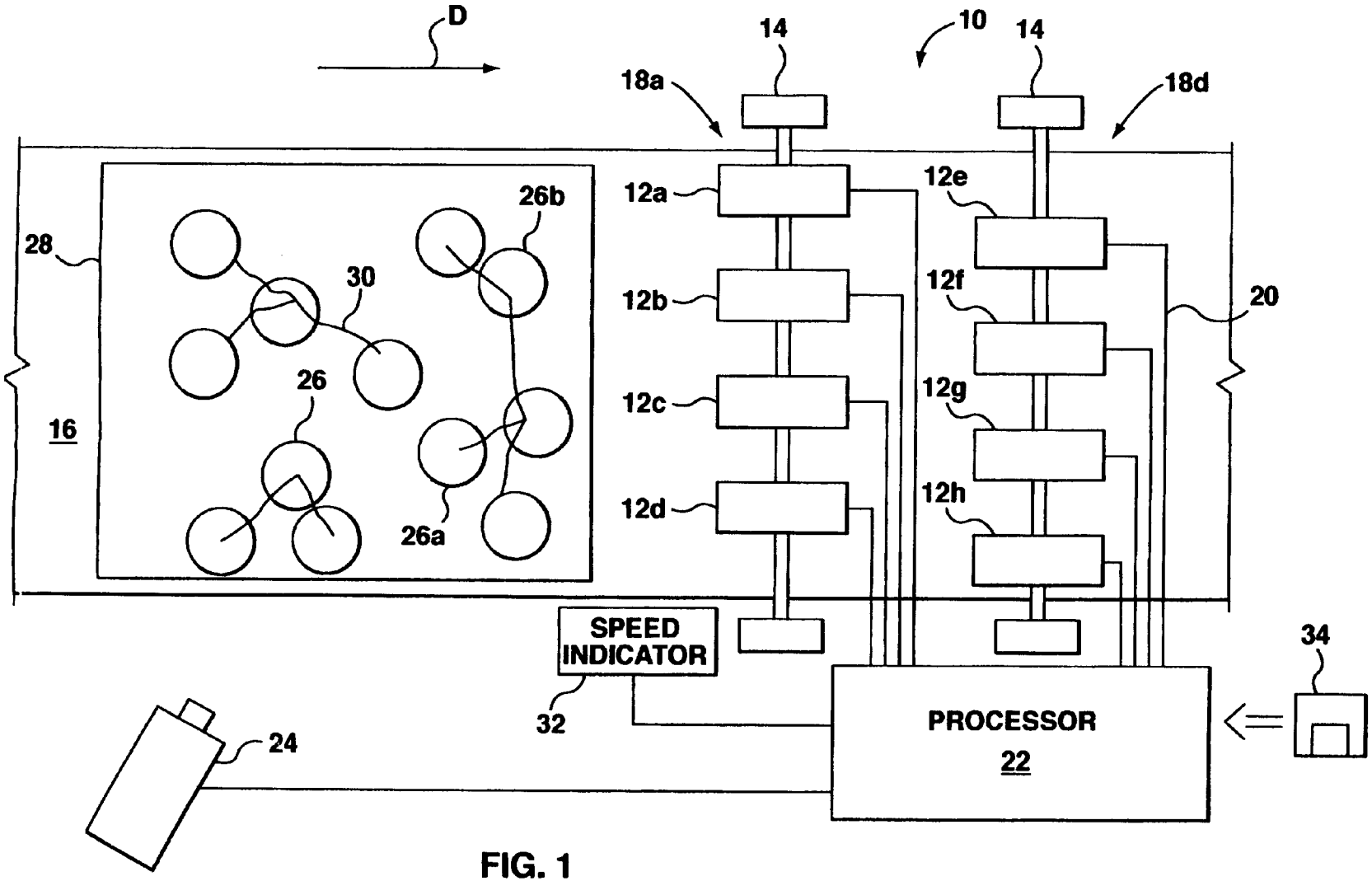
FIG. 1 is a top plan schematic view of a labelling apparatus made in accordance with this invention.

Turning to FIG. 1, a labelling apparatus 10 comprises labellers 12*a* to 12*h* (referred to individually as labellers 12) mounted by mounts 14 at a fixed position above a conveyor 16. The labellers 12 are arranged as an upstream bank 18*u* of labellers (12*a* to 12*d*) and a downstream bank 18*d* of labellers (12*e* to 12*h*). Each bank 18*u*, 18*d* of labellers extends transversely of the conveyor 16. The labellers in a bank are equally spaced and the labellers of the downstream bank 18*d* are offset from those of the upstream bank 18*u* so that each labeller has a different transverse position over the conveyor. Further, the labellers 12 extend substantially across the width of the conveyor so as to provide eight distinct transverse positions across the conveyor. The labellers 12 are operatively connected to processor 22 on paths 20.

The labellers 12 are downstream of a camera 24; the camera is arranged to image an area of the conveyor and output this image to the processor 22. In this regard, products 26 may be carried in trays 28 and the camera may image an area which captures one such tray. For example, as illustrated, the products may be vine ripened tomatoes which remain attached to vines 30 such that the products are irregularly spaced. A conveyor position indicator 32 (which, for example, may be a rotary encoder, a sensor which senses marks on the conveyor, or, where the conveyor moves at a known constant speed, simply a timer) also outputs to the processor.

A labeller 12, in its various aspects, is illustrated in FIGS. 2 to 7. Referencing FIGS. 2A and 2B, the labeller 12 has a turret 40 rotatably mounted to a base 38. A drive belt 42 connects the turret 40 to a stepper motor 44. A label cassette 50 is releasably mounted to base 38 by way of a loading peg 48 at the rear of the cassette which slides into a notch 52 on the base and allows the cassette to be pivoted forwardly into a releasable latch (not shown) at the front of the base.

Figure 8:
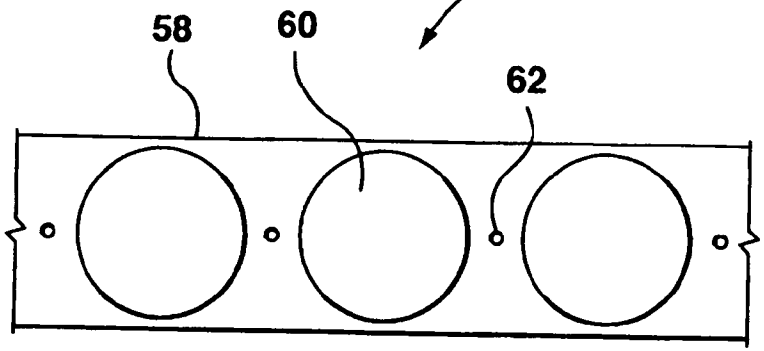
FIG. 8 is a plan view of a label web used with the apparatus of FIG. 1.
Figure 9:
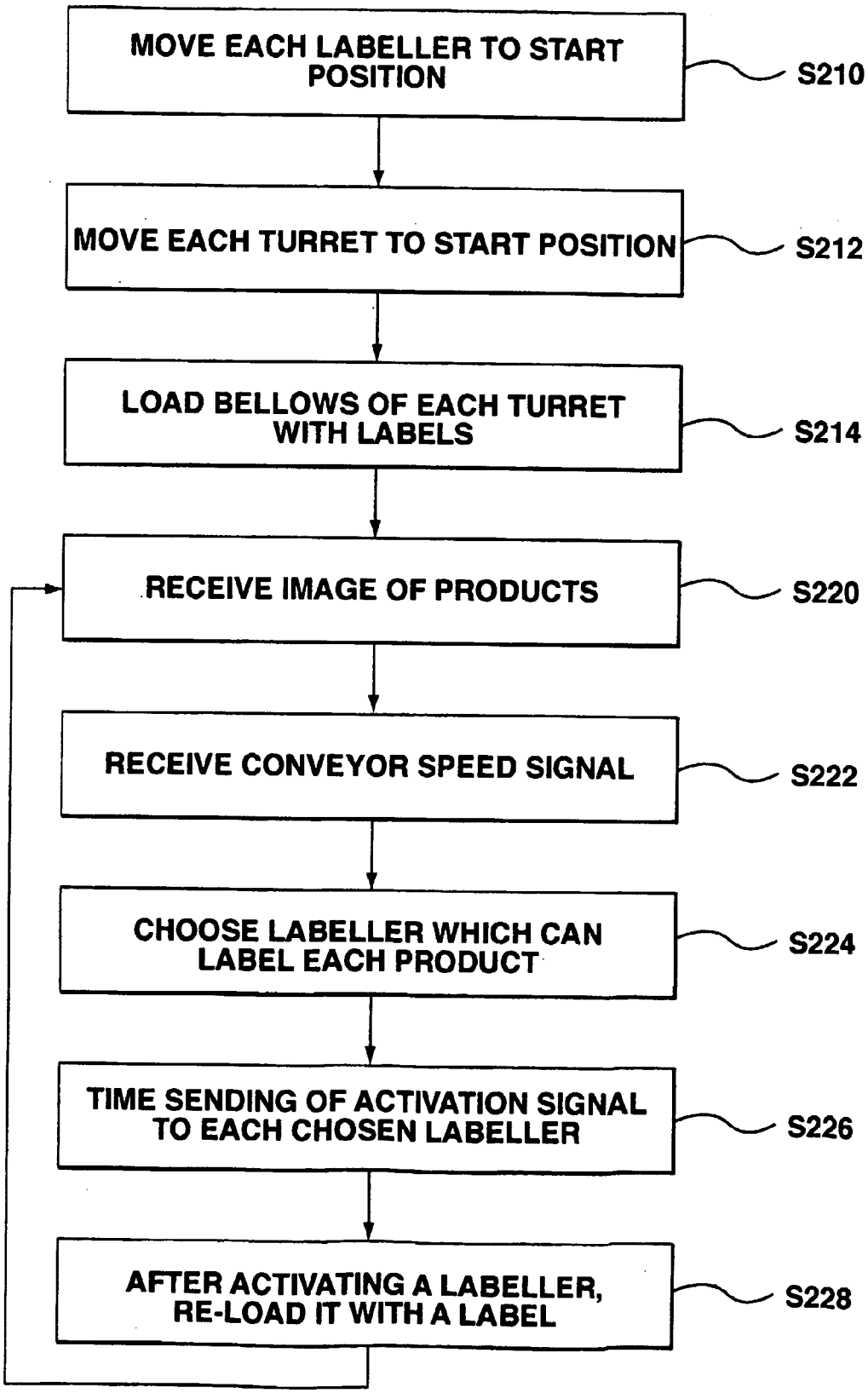
FIG. 9 is a flow diagram for operation of a processor of the apparatus of FIG. 1.
Figure 10:
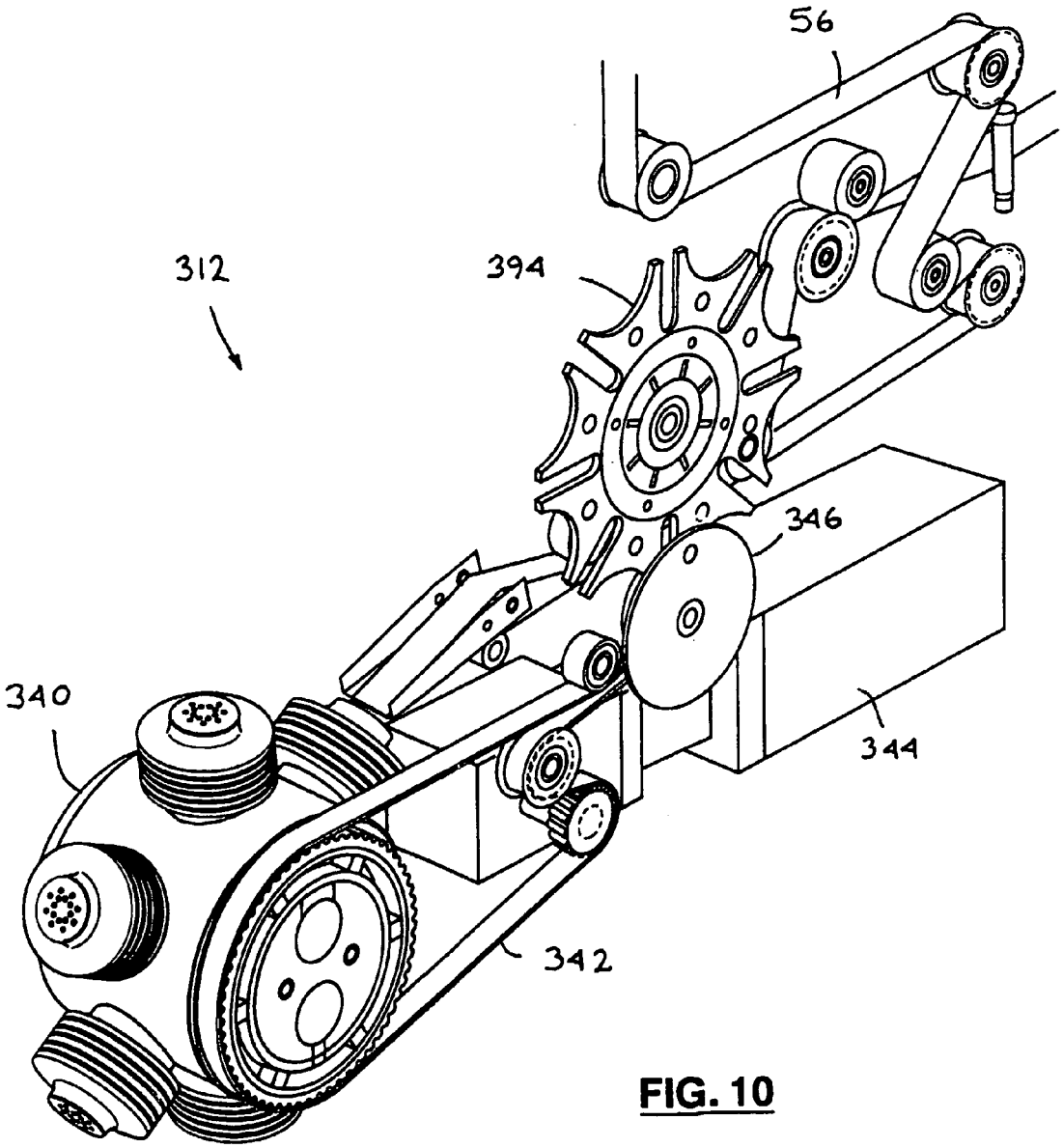
FIG. 10 is a simplified perspective view of a labeller made in accordance with another embodiment of this invention.

The label cassette has a cassette magazine 54 to which is wound a label web 56 of the type illustrated in FIG. 8. Thus, the web comprises a release tape 58 carrying a plurality of labels 60 backed with a pressure sensitive adhesive. A pin hole 62 is provided in the release tape between each pair of labels. The label web extends from the cassette magazine 54 to a pin wheel 66 of the label cassette 50, then through a C-channel member 68 to a label pick-up station 70, with the release tape 58 returning to wind around a pin wheel 72. Pin wheel 72 is concentrically mounted to drive pinion 74. With the cassette 50 mounted to base 38, the drive pinion 74 is meshed with a two-sided timing belt 78 on the base. The two-sided timing belt is driven by a stepper motor 84. A communication path 20 from the processor 22 (FIG. 1) terminates at stepper motors 44 and 84.

Figure 3:
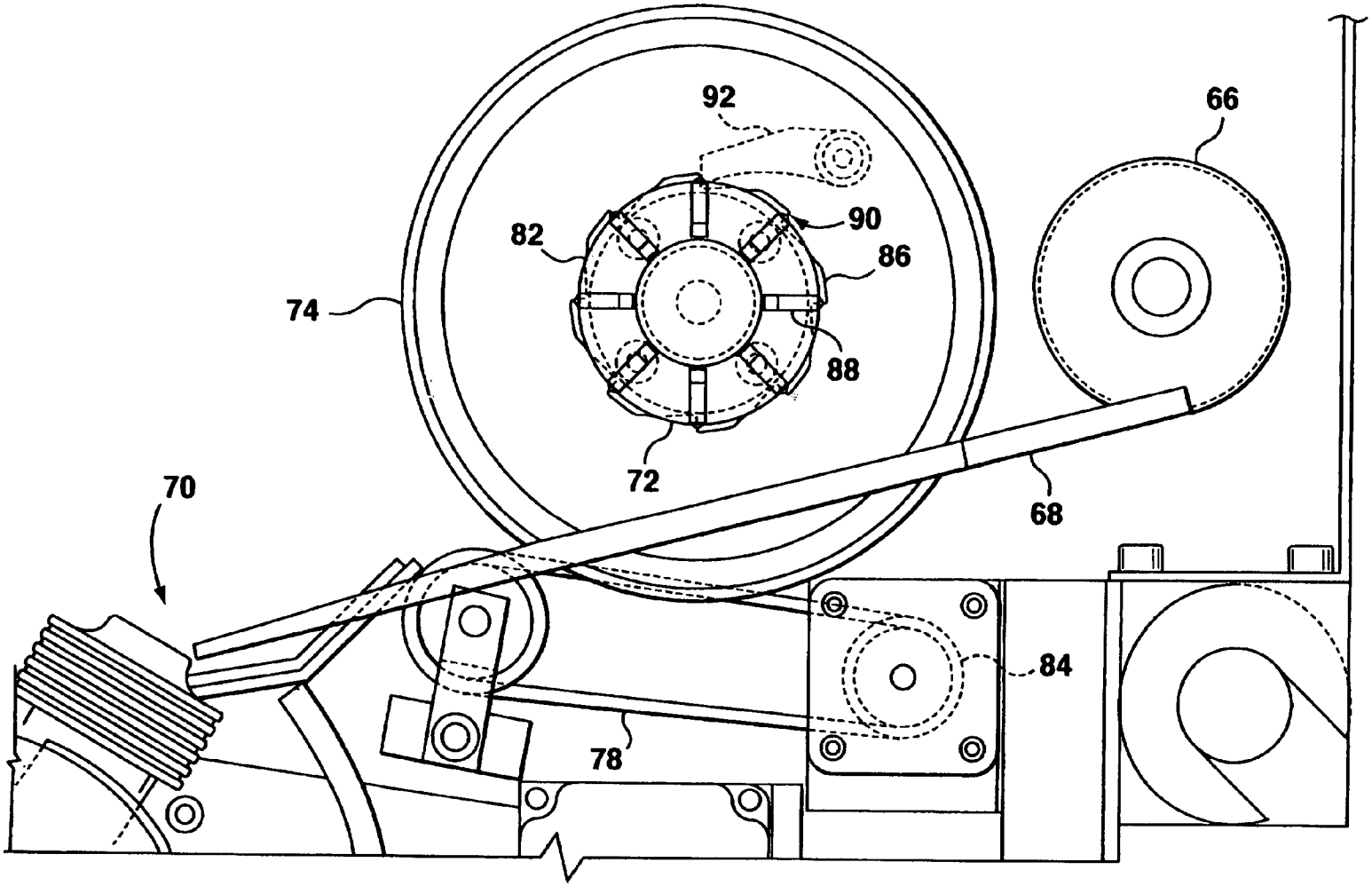
FIG. 3 is a side view detail of a portion of the labeller of FIGS. 2A, 2B.

As seen in FIG. 3, pin wheel 72 has a circumferential portion 82 which carries a ratchet tooth 86 for each pin 88 on the wheel 72. Each ratchet tooth has an operative edge 90 aligned with a pin 88. A spring loaded pawl 92 is urged against circumferential portion 82.

Figure 4:
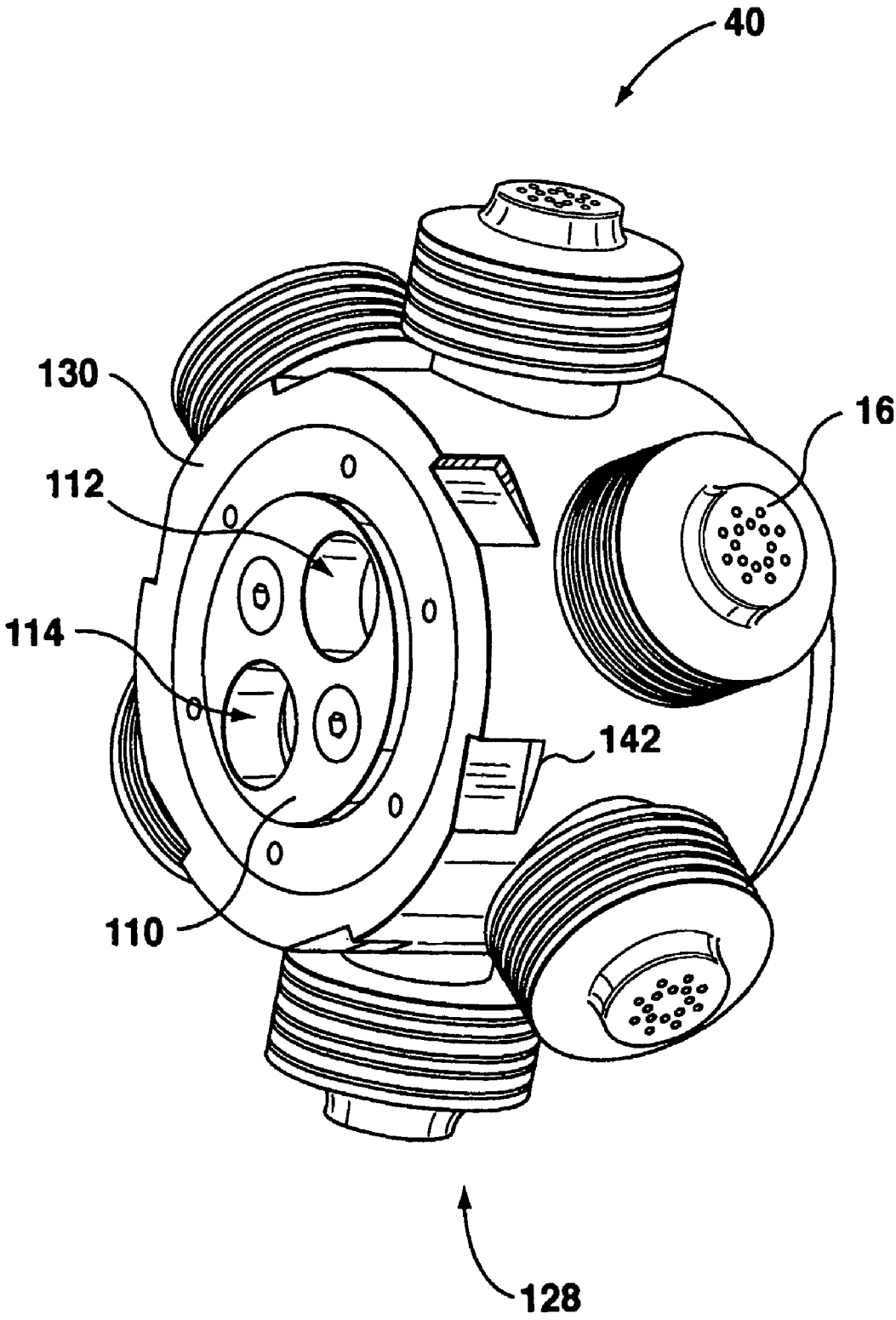
FIG. 4 is a perspective view of a turret of the labeller of FIGS. 2A, 2B.
Figure 5:
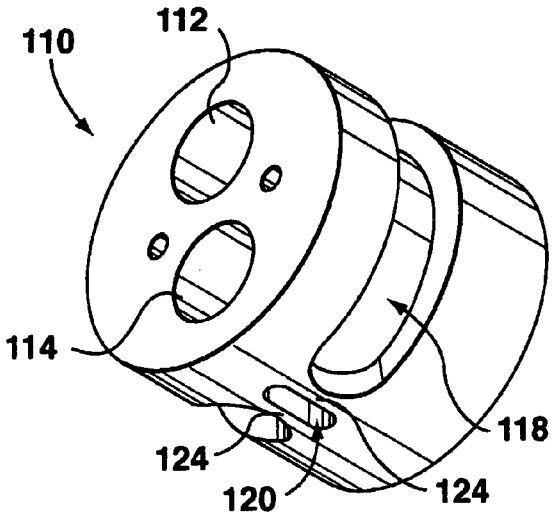
FIG. 5 is a perspective view, and FIG. 5A a side view, of a portion of the turret of FIG. 4, FIGS. 6A and 6B are front and side views, respectively, of another portion of the turret of FIG. 4.
Figure 5A:
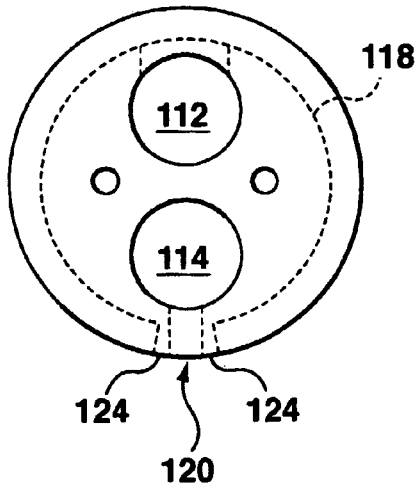

The turret 40 is detailed in FIGS. 4 to 7. Referencing FIGS. 4, 5, and 5A, turret 40 has a stationary core 110 fixed to base 38. The core has a port 112 for connection to a vacuum source (not shown) and a port 114 for connection to a source of positive pressure (not shown). As shown in FIGS. 5 and 5A, port 112 connects to an airway having a channel 118 extending continuously about substantially all of the circumference of channel 118 and opening to the periphery of the core. Port 114 connects to an airway having a slot 120 opening to the periphery of the core between the ends of the channel 118 so as to leave lands 124 between the ends of the channel 118 and slot 120. The core 110 is oriented so that slot 120 is positioned over a label applying station 128.

Figure 6A:
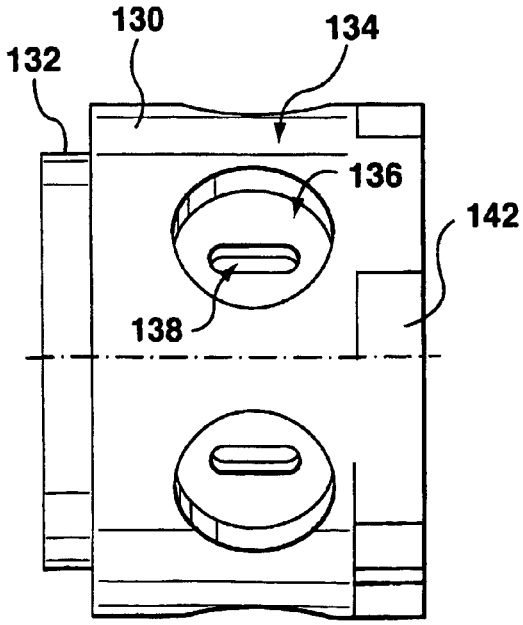
Figure 6B:
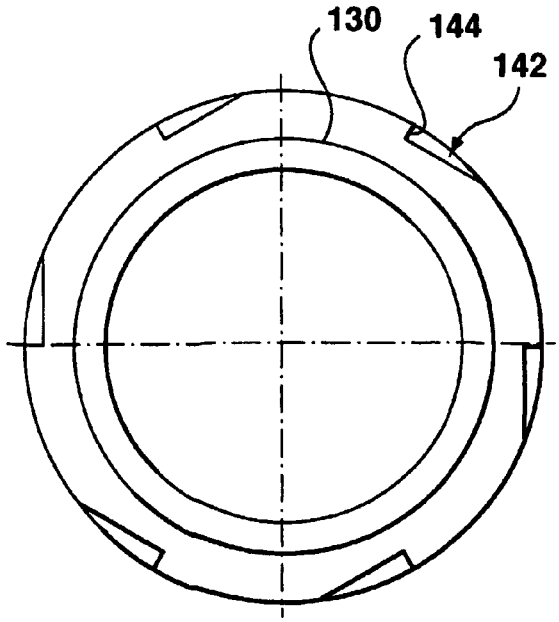

Referencing FIGS. 6A and 6B along with FIG. 4, turret 40 has a sleeve 130 closely fit to the core 110. Both the core and sleeve are fabricated of an ultra-high molecular weight (UHMW) polymer, or other material having a low coefficient of friction. Thus, closely fitting sleeve 130 can rotate on core 110 absent other bearings between the two members. Sleeve 130 has a flange 132 which receives drive belt 42 (FIG. 1). The sleeve also has a number of peripheral through holes 134 comprising cylindrical openings 136 extending from its outer surface which terminate in slots 138 extending through its inner surface. A ratchet tooth 142 is associated with each through opening 134 having an operative edge 144 proximate a leading edge of its associated opening 134. A spring loaded pawl (not shown) mounted to base 38 (FIG. 2A) is urged against the ratchet tooth bearing periphery of sleeve 130.

Figure 7:
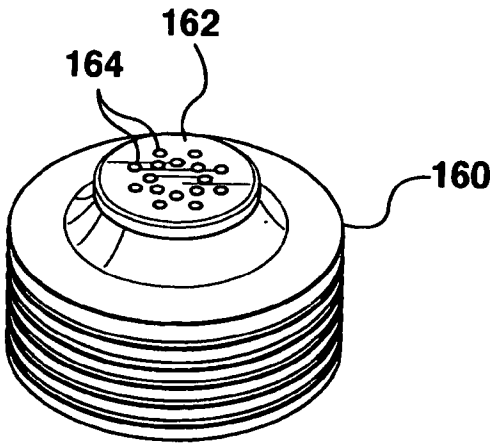
FIG. 7 is an exploded view, and FIG. 7A a side view, of a further portion of the turret of FIG. 4.
Figure 7:
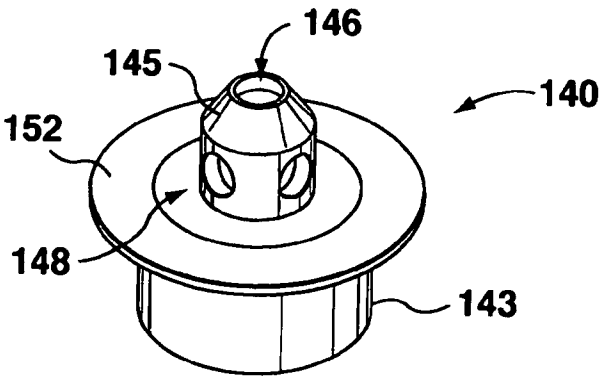
Figure 7A:
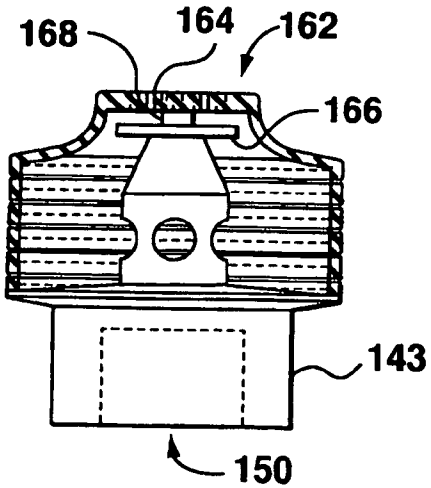

Referring to FIGS. 7 and 7A with FIG. 4, an air diffuser 140 has a base 143 which is press fit into each cylindrical opening 136 (FIG. 6A) of sleeve 130. The air diffuser also has a snout 145 with a central opening 146 and side openings 148. The air diffuser base 143 has a central opening 150 in fluid communication with the openings 146, 148 of the snout 145. The air diffuser has a lip 152 for mounting a bellows 160. Each bellows 160 is fabricated of a flexible material, such as rubber or silicone, which can be stretched over a lip 152 of an air diffuser 140. The tamping end 162 of the bellows is perforated with pin holes 164. A one-way valve at the tamping end comprises a flexible disk 166 internally mounted in the bellows 160 at a small stand off from the tamping end 162 by a short post 168. It will be noted from FIG. 7A that with a bellows 160 mounted to an air diffuser 140, the disk 166 seats on the central opening 146 of the air diffuser when the bellows is in its fully retracted position.

To prepare labelling apparatus 10 for operation, label cassettes 50 are first readied. To ready a cassette, a full magazine 54 is loaded on the cassette then the end of the label web 56 is drawn from the magazine around pin wheel 66, through channel 68 and back to pin wheel 72 such that the pins of each pin wheel are embedded in the pin holes of the web. So as not to waste labels during set-up, the web may have a leader portion free of labels. A readied cassette 50 may be mounted to the base 38 of a labeller 12 by inserting peg 48 of the cassette into notch 52 of the base then tilting the cassette 50 forwardly until the cassette latches to a latch carried by the base 38. While the cassette is being tilted forwardly, pinion 74 contacts double-sided timing belt 78 ever more forcefully, deforming the belt thereby ensuring that teeth of the pinion 74 will mesh with the belt. In the latched position of the cassette seen in FIG. 2B, belt 78 is perpetually deformed by the pinion. This deformation results in the timing belt wrapping around a portion of the periphery of the pinion 74 so that a greater number of teeth of the pinion engage with the timing belt.

Next each labeller may be moved to a start position (S210). To do so, processor 22 signals stepper motor 84 to rotate in a direction which will wind the label web 56 back on to the magazine 54. With specific reference to FIG. 3, stepper motor 84 then rotates in a counter clockwise direction so that pinion 74, with its concentrically mounted pin wheel 72, rotates clockwise. This continues until pawl 92, which rides along periphery 82 of the pin wheel 72, engages an engaging face 90 of a ratchet tooth 86, whereupon stepper motor 84 stalls out as it can rotate counter clockwise no further. It will be recalled that there is a pin 88 for each ratchet tooth 86 and that the engaging face 90 of each tooth 86 has the same relative position with respect to an associated pin 88. It will also be recalled that there is one pin hole 62 between each pair of labels on the label web. In consequence, with an appropriate choice of the distance between pin wheel 72 and the label pick-up station 70, a label 60 will be at a pre-selected location with respect to the labelling station when the stepper motor 84 stalls. This is the start position for the labelling cassette 12. The start position of the label cassette will normally be such that a label is present just upstream of the label pick-up station 70. Similarly, processor 22 may signal stepper motor 44 to rotate backwards (clockwise) until a pawl (not shown) engages the engaging face 144 of a ratchet tooth 142 on sleeve 130 of turret 40 whereupon stepper motor 44 will stall (S212). This defines the start position for turret 40. The start position for turret 40 will normally be such that a bellows 160 is at the label pick-up station 70.

If not done previously, the positive and negative pressure ports 114, 112, respectively, of each labeller are then coupled to appropriate air pressure sources. This couples a negative pressure to each bellows 160 of the turret 40 of a labeller thereby drawing each bellows to a collapsed position shown in FIG. 4. A bellows remains in this collapsed state except when at the label applying station 128. This is due to the configuration of the core 110 with its substantially circumferential channel 118 coupled to the vacuum source. The lands 124 of the core substantially isolate the negative pressure in the channel 118 from the positive pressure in the slot 120 (which slot is aligned with the label applying station).

Figure 2A:
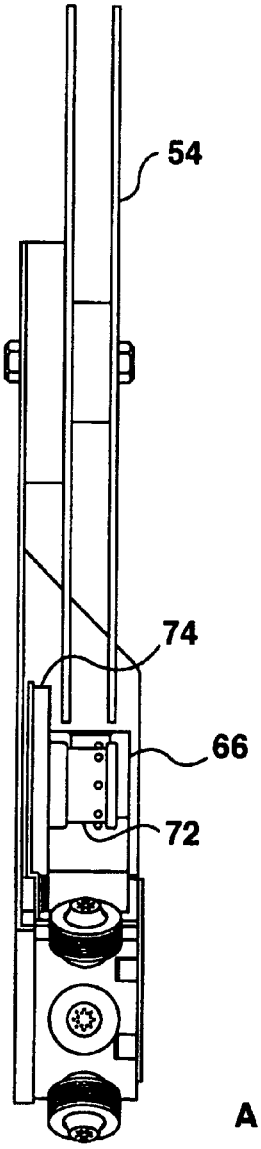
FIGS. 2A and 2B are front and side views, respectively, of a labeller which may be used in the apparatus of FIG. 1.
Figure 2B:
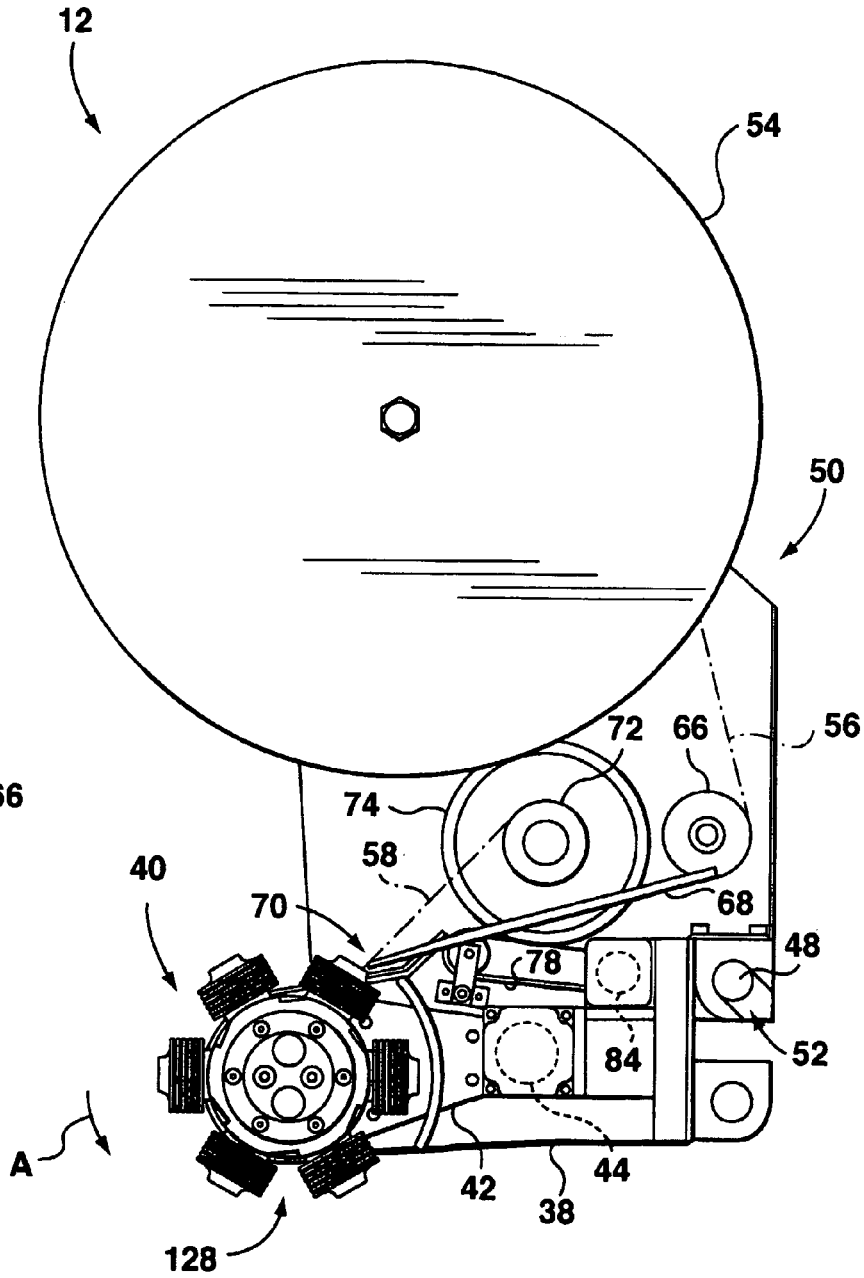

With a vacuum source coupled to a bellows 160, the one-way disk valve 166 is open such that there is a low pressure beyond the tamping head 162 of the bellows. Thus, a bellows 160 at the label pick-up station is ready to pick-up a label. The processor then sends an activation signal to stepper motor 84 causing it to advance the label web 56 by a fixed increment. This moves a label on the web from just upstream of the label pick-up station 70 to station 70 whereat the release tape turns back on itself around the end of channel 68 causing the label to peel off. Since a bellows 160 is already at this station, the released label 60 is sucked onto tamping head 162 presenting its pressure sensitive adhesive side outwardly. The processor then activates stepper motor 44 to rotate the turret 40 by a fixed increment in advancement direction A (FIG. 2B) so as to advance the next bellows 160 to the label pick-up station 70 and then again activates stepper motor 84 to advance the next label to the label pick-up station. This is repeated until all bellows extending in the advancement direction A between the label pick-up station and the label applying station 128 are loaded with a label (as shown in FIG. 2B, this would be four bellows) (S214).

Conveyor 16 may be started in downstream direction D. The conveyor may hold a number of trays 28, each loaded with products 26. When a tray reaches an imaging station, camera 24 images the tray and its contents. This image is passed to processor 22 (S220) as is a conveyor position indication signal from position indicator 32 (S222). The received image of the products 26 (and the vines 30) on the tray 28 allows the processor to determine the co-ordinates of a target area for labelling a product (i.e., the processor determines this target area relative to a frame of reference). Based on the determined target area, the processor determines which labeller 12 has a transverse position over conveyor 16 which is within the transverse extent of this target area. This labeller is chosen to label the product (S224). For example, the processor 22 may determine that a target area of product 26*a* can be hit by labeller 12*h* of bank 18*d* and so choose labeller 12*h* for labelling product 26*a*. Similarly, the processor may determine that labeller 12*b* of the upstream bank 18*u* should label product 26*b*. The distance between the imaging station and each bank 18*u*, 18*d* of labellers is pre-defined and stored in the processor 22. With knowledge of this, the movement of the conveyor, and the image of the products on the tray, the processor may determine when the target area of any product 26 on the tray 28 will reach the label pick-up station 70 of each bank 18*u*, 18*d* of labellers. Having chosen a labeller 12 for a given product 26, the processor 22 can then time the sending of an activation signal to stepper motor 44 of the chosen labeller so that a label is applied to the given product (S226).

More particularly, the activation signal sent by the processor to stepper motor 44 advances the stepper motor 44 by one step to move a bellows 160 which had previously been loaded with a label through the label applying station. While moving through the label applying station, the bellows 160 registers with slot 120 in core 110 thereby coupling the source of positive air pressure to the air diffuser 140 of the bellows 160. As air attempts to push out of the air diffuser into the bellows, air is initially blocked from exiting central opening 146 in the snout 145 of the air diffuser in view of disk 166 of the bellows blocking this opening. Consequently, initially, most air is directed out of the side openings 148 of the snout 145. This air fills the vacuum in the bellows.

Meanwhile, the air pressure will seat disk 166 against the pin holes 164 in the tamping end 162 of the bellows to block these perforations. With the vacuum in the bellows replaced by a positive pressure, the bellows quickly extends until it tamps the product at the labelling station 128, thereby applying a label to the product. As the tamping bellows moves past the label applying station 128 it is again coupled to a source of vacuum which quickly draws the bellows back to its collapsed position. At the end of the step by the stepper motor 44, another bellows 160 will have advanced to the label pick-up station 70. The processor may then cause the stepper motor 84 of the label cassette 50 to advance another label to the label pick-up station in order to load the bellows now at this station (S228), and the process may repeat.

Processor 22 may be loaded with software from computer readable medium 34 in order to perform the described operations. Computer readable medium 34 may, for example, be a disk, a solid state memory device, or a file downloaded from a remote source.

From the foregoing, it will be apparent that each step of stepper motor 44 moves one bellows 160 on turret 40 through the label applying station 128 and stops the turret so that another bellows is registered with the label pick-up station 70. The speed of the stepper motor may be adjusted so that a bellows moving through the label applying station is coupled to the source of positive pressure air for an appropriate length of time.

In consequence of air pressure initially being communicated to the bellows through the side openings of the air diffuser 140, the bellows will contain a positive pressure when it begins its tamping motion. This makes the tamping motion faster and more predictable.

When a magazine 54 of a cassette 50 is spent, the cassette 50 may be removed, re-loaded, and replaced.

It will be apparent that the processor 22 may control banks of fixed labellers other than tamping labellers 12 in order to select a labeller to apply a label to a product. Thus, in a modified system, bellows labellers 12 may be replaced with piston-type tamping labellers (such as the labellers described in U.S. Pat. No. 5,645,680 to Rietheimer, the contents of which are incorporated by reference herein). In such case, processor 22, working with camera 24 and position indicator 32, may send activation signals to the piston-type tamping labellers. Further, where the products were such that a wiping labeller would suffice, bellows labellers 12 could be replaced by labellers which wipe a label onto a product.

While the labelling apparatus 10 has been illustrated as having two banks of labellers, with sufficiently narrower labellers, one bank may suffice. Further, to provide a smaller granularity between transverse positions of the labellers, additional banks of labellers could be provided, with each labeller having a smaller transverse offset from transversely adjacent labellers.

Where the conveyor position indicator is simply a timer, it may be incorporated in the processor 22.

Although the stepper motors 44, 84 have been described as being electronically controlled by processor 22, alternatively, they could be mechanically, or electro-mechanically controlled. For example, an overhead deformable finger could be located at a fixed position upstream of each labeller such that the finger is deformed when a product contacts it, resulting in a microswitch temporarily closing. This could activate a timer which, when it times out, sends a signal to the associated labeller causing it to execute a tamping operation and re-load a bellows with a label. Once the timer times out, it is re-set. If the conveyor speed was fixed, each timer could be loaded with an appropriate value based on this speed and the distance the finger was positioned upstream of the associated labeller.

FIGS. 10 to 13 illustrate a labeller made in accordance with another embodiment of this invention. Turning to these figures, wherein like parts to those of the labeller of FIGS. 2 to 7 have been given like reference numerals, labeller 312 has a turret 340 rotatably mounted to a base 338. Turret 340 is identical to turret 40 of FIGS. 4 to 7 except that turret 340 has no ratchet teeth 140 (FIG. 6B). A timing drive belt 342 engages with a (cogged) timing wheel 339 of turret 340, a timing wheel 341 of protuberanced wheel 346, and a timing wheel 343 of gearing 348 driven by an intermittent drive, which in the illustrative embodiment is stepper motor 344. The timing wheels of the turret and protuberanced wheel are chosen so that the turret will rotate through a part of a rotation equal to the inverse of the number of the bellows 160 for each complete rotation of the protuberanced wheel 346. Thus, in the illustrative embodiment with six bellows, the turret will rotate through one-sixth of a revolution for each revolution of the protuberanced wheel. The protuberanced wheel has a protuberance in the nature of a pin 345 with a longitudinal axis that is parallel to the axis of rotation of the protuberanced wheel 346. The protuberanced wheel also has a locating arc 349 which is diametrically opposite to pin 345. An optional sensor 347 is attached to the base 338 at a position such that pin 345 rotates past the sensor.

A label cassette 350 has a rearward notch 352, a forward facing corner cut-out 354 with a notch 356 and a rearward facing sloped surface 358 with a notch 359. As will be explained, these features interact with features of the base 338, namely mounting pin 360, rearward facing right angled label cassette locating corner 362, and forward facing sloped label cassette urging surface 364 to releasably mount the cassette to, and locate the cassette on, base 338.

The label cassette has a cassette magazine 54 to which is wound a label web 56 of the type illustrated in FIG. 8. The label web extends around re-directing rolls 366, 368, spring biased pressure roll 370, and re-directing roll 372 to tongue 374. A pressure roll 378 holds the web adjacent the in-feed bottom face 380 of the tongue. The web wraps around the end 382 of the tongue so as to double back on itself. Label pick-up station 70 is adjacent the tongue end 382. The label-free release tape downstream of the label pick-up station 70 extends around re-directing roll 384, pin wheel 386, and re-directing roll 388, thence through nip rollers 390, 392 to a waste area (not shown).

Pin wheel 386 is co-axially fixed to geneva gear 394. The geneva gear has a series of slots 396 and locating cups 398. An elastic drive belt (not shown) couples nip roller 390 to pin wheel 386.

Figure 13:
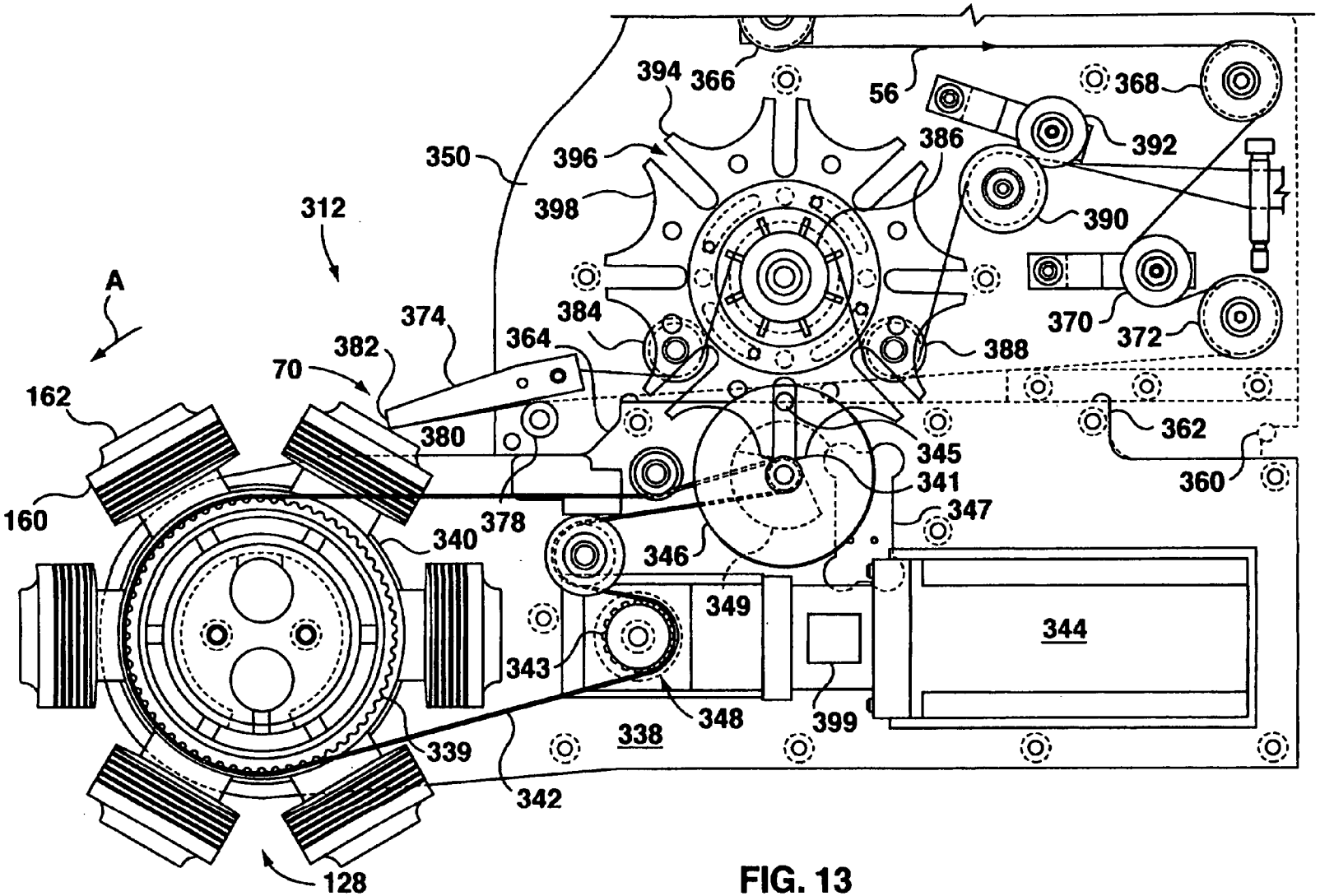
FIG. 13 is another side view of a portion of the labeller of FIG. 10 shown in a label pickup position.

The timing drive belt 342 is initially fitted so that one of the bellows 160 is at properly positioned at the label pick-up station 70 when the pin 345 of the protuberanced wheel 346 is in the position illustrated in FIG. 13. In this position, the label pick-up face (tamping end) 162 of the bellows 160 at the label pick-up station 70 makes an angle with the bottom face 380 of tongue 374 of between about 130 and 150 degrees, and preferably about 140 degrees.

The labeller may have a rotary encoder 399 that, along with sensor 347, outputs to the processor 22 (FIG. 1). In consequence, the processor can know the position of pin 345.

To prepare labeller 312 for operation, a label cassette 350 is first readied. This requires loading a full label web magazine on the cassette, then drawing the end of the label web from the magazine around rollers 366, 368, 370, and 372 then along the bottom face 380 of the tongue 374 above roller 378. The label web is then wound around the end 382 of the tongue, back to roller 384, around pin wheel 386—such that the pins are embedded in the pin holes of the web—around roller 388, and through nip rollers 390, 392 to the waste area (not shown). Depending upon the size of the labels, it may be necessary to ensure that a label is at the end 382 of the tongue (and hence at the label pick-up station) when a slot 396 of the geneva gear opens downwardly (i.e., when the gear is in the position illustrated in FIG. 13). A label cassette that has been readied, may be mounted on a labeller base 338 by first angling the cassette with respect to the base and engaging the rearward facing notch 352 of the cassette with the mounting pin 360. The spacing between the mounting pin 360 and the right angled label cassette locating corner 362 is such that as the cassette is rotated toward a mounted position, the forward facing corner cut-out 354 of the label cassette just clears locating corner 362 of the base. Similarly, the rearward facing sloped surface 358 just clears the corner 365 of the base above forward facing sloped label cassette urging surface 364. Notches 356, 359 in the cassette avoid the cassette binding with the base 338 as the cassette is rotated into its mounted position. Once the cassette is rotated such that its rearward facing sloped surface 358 rests on forward facing sloped label cassette urging surface 364 of the base, the weight of the cassette causes rearward facing sloped surface 358 to slip downwardly on forward facing sloped label cassette urging surface 364 until the vertical back surface of forward facing corner cut-out 354 firmly abuts the vertical rear surface of rearward facing right angled label cassette locating corner 362. In this final resting position, the label cassette is mounted to the base. If desired, a latch may be provided to retain the label cassette in its mounted position.

Figure 12:
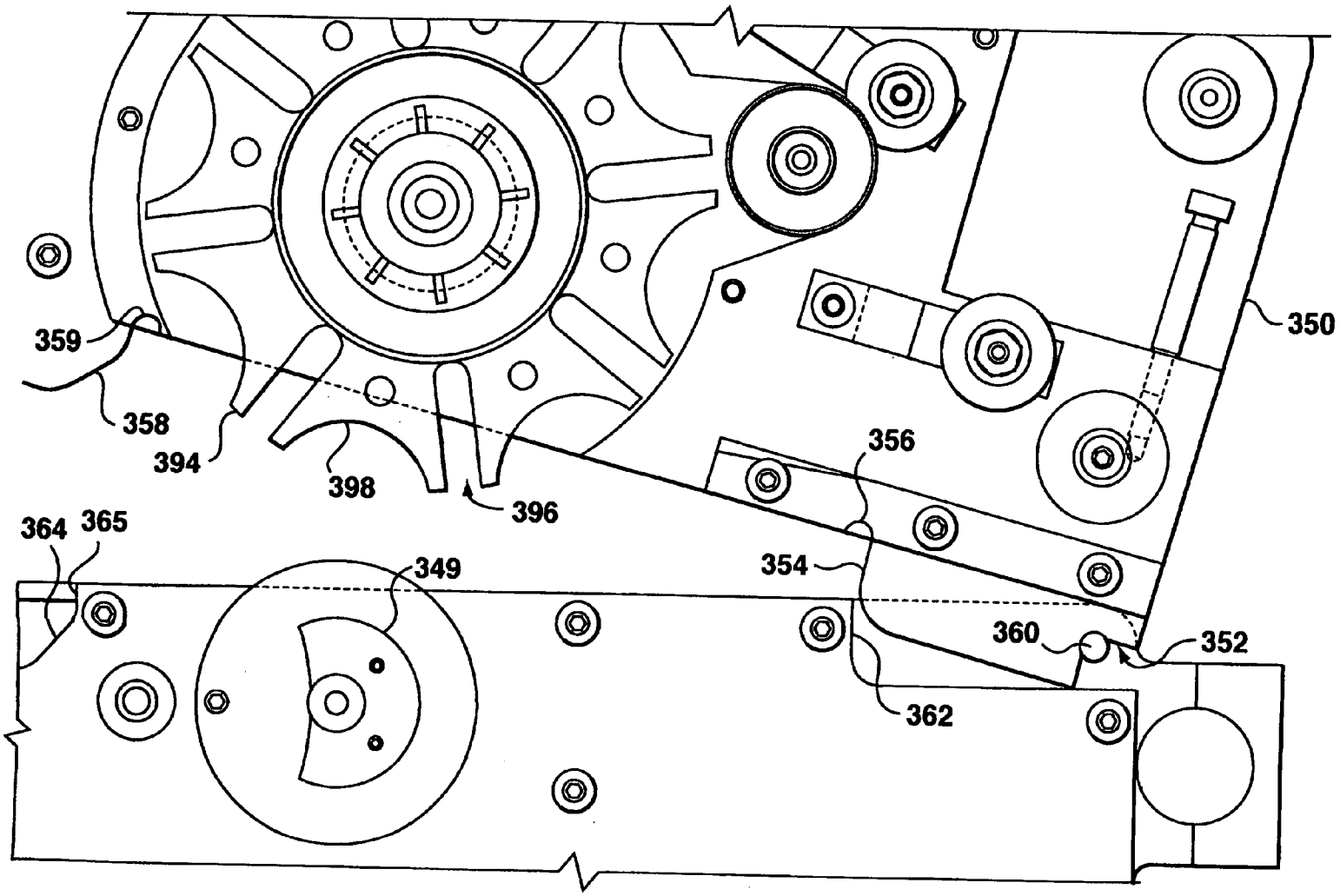
FIG. 12 is another side view of a portion of the labeller of FIG. 10 shown during cassette mounting.

As the cassette is rotated to its mounted position, the geneva gear should be turned so that one of the locating cups 398 faces downwardly, as shown in FIG. 12. Additionally, the protuberanced wheel 346 should be turned to a position whereat at least a portion of the locating arc 349 faces upwardly, also as shown in FIG. 12. In this position, pin 345 will not interfere with the geneva gear during cassette mounting. Furthermore, the upward facing portion of the locating arc 349 will nestle into the downwardly facing cup 398 of the geneva gear 394. The locating arc, when nestled in a cup 398, will restrain the geneva gear from rotation. As will become apparent, in this restrained position, a slot 396 of the geneva gear is positioned for reception of pin 345.

Figure 11:
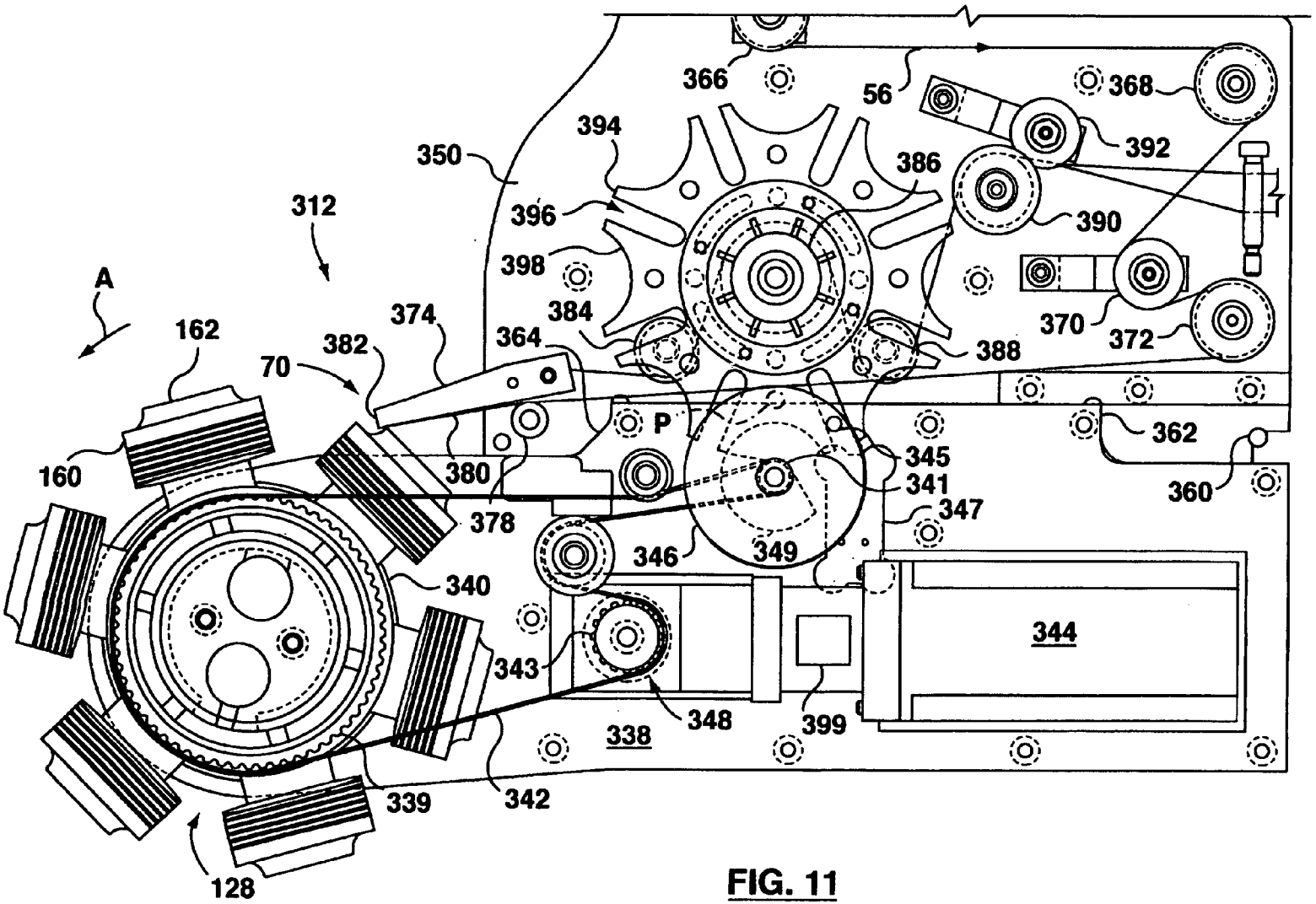
FIG. 11 is a side view of a portion of the labeller of FIG. 10.

If not already done, the positive and negative pressure ports 112, 114 (FIG. 4) of each labeller may be coupled to appropriate air pressure sources. As aforedescribed, this couples a negative pressure to each bellows 160 of the turret (other than a bellows at the label applying station 128), thereby drawing each bellows to a collapsed position, as shown in FIG. 11. With a vacuum source coupled to a bellows 160, the one-way disk valve 166 (FIG. 7A) is open such that there is a low pressure beyond the tamping face 162 of the bellows.

The processor 22 (FIG. 1) may then send an activation signal to stepper motor 344 to cause it to advance turret 340 and protuberanced wheel 346 in advancement direction A. As the protuberanced wheel rotates, the locating arc 349 will rotate through, and then leave, the locating cup 398 of geneva gear 394 in which it is initially nestled. This will remove the rotation restraint from the geneva gear. It will be recalled that the restrained position of the geneva gear positions a slot 396 of the gear in a position such that a pin 345 may enter it, as shown in FIG. 11. Therefore, as the protuberanced wheel continues to rotate, its pin enters, and then leaves, a slot 396 of the geneva gear and drives the geneva gear to rotate. In this embodiment, the pin only rotates the geneva gear a portion of a revolution for each complete revolution of the geneva gear, such that the geneva gear is discontinuously advanced with respect to the protuberanced wheel. Once the pin 345 reaches phantom position P (FIG. 11), as shown in FIG. 13, the turret 340 is positioned with a bellows 160 at the label pick-up station 70. Thus, a label moved to the pick-up station by the geneva gear will be sucked on to the tamping face 162 of the bellows at the label pick-up station. In this regard, it will be noted that the angular velocity of the geneva gear will vary in proportion to the positive going portions of a sine wave: initially accelerating, moving fastest when the protuberanced wheel is at the position shown in FIG. 13, then decelerating. This has the advantage that, with suitable registration of the label web when it is loaded on the cassette, a label will initially be peeled away more slowly from the release tape as the tape winds around the end of the tongue. This helps ensure separation of the label from the release tape.

Because of the elastic drive belt between the nip roller 390 and the pin wheel 386 of the geneva gear, a driving torque is applied to nip roller 390 whenever the geneva gear 394 rotates. The elasticity of the drive belt allows the belt to slip on nip roller 390 after the release tape is tensioned. In consequence, the nip rollers 390, 392 act to maintain tension on the label release tape. This ensures the tape remains fully engaged with the pin wheel 386.

Protuberanced wheel 346 may be rotated through four complete revolutions so that all four bellows upstream of the label applying station are loaded with a label. Advantageously, sensor 347 senses pin 345 once during each revolution and passes this information to the processor 22. With this information, and information from rotary encoder 399, the processor can stop the stepper motor 344 with locating arc 349 nestled in a cup 398 of the geneva gear and with a bellows 160 at a known position upstream of the label applying station 128.

When there is a demand for a label from labeller 312, processor 22 causes the stepper motor 344 to advance the turret so that a bellows (previously loaded with a label) advances to the label applying station. If desired, the processor can stop the stepper motor with a bellows at the label applying station for any given dwell time.

While the protuberanced wheel has been described as having one pin, it could have two or more pins provided the gear ratio between the turret and protuberanced wheel was adjusted appropriately. The protuberanced wheel and geneva gear may also need to be re-sized to accommodate an increased number of pins. While not preferred, the locating arc 349 of the protuberanced wheel could be omitted.

Optionally, the protuberanced wheel may be a gear (such as a partially toothed spur gear) with teeth extending along one or more arcs so as to leave the remainder of the periphery of the gear free of teeth. In this situation, the geneva gear could be replaced by a suitable gear (such as a spur gear).

While labellers 12 and 312 may be used in the labelling apparatus 10 of FIG. 1, these labellers may also be used in other apparatus and may also be used as stand-alone labellers.

Other modifications will be apparent to those skilled in the art and, therefore, the invention is defined in the claims.

What is claimed is:

1. A labelling apparatus comprising:

a turret carrying a plurality of tamping labellers;

a protuberanced wheel having at least one protuberance;

an intermittent drive for intermittently driving said turret and said protuberanced wheel;

a slotted wheel driven by said protuberanced wheel such that it is discontinuously advanced during rotation of said protuberanced wheel, said slotted wheel including a slot that is operatively engaged by said protuberance, said slotted wheel for driving a label web for feeding labels to said tamping labellers.

2. The labelling apparatus of claim 1 wherein said protuberanced wheel is a wheel having a pin with a longitudinal axis parallel to an axis of rotation of said protuberanced wheel.

3. The labelling apparatus of claim 2 wherein said slotted wheel is a Geneva gear.

4. The labelling apparatus of claim 1 wherein said protuberanced wheel is a gear having teeth along one or more arcs and being free of teeth between said arcs and wherein said slotted wheel is a gear.

5. The labelling apparatus of claim 4 wherein each said gear is a spur gear.

6. The labelling apparatus of claim 1 wherein said intermittent drive is a stepper motor.

7. The labelling apparatus of claim 1 further comprising a tongue providing a label web path around a tongue end, said tongue end being at a label pick-up station, said tongue having a label web in-feed surface configured such that a label immediately upstream of said tongue end lies in a plane that makes an angle of between about 130 and 150 degrees with a label pick-up face of a tamping head of a one of said tamping labellers positioned at said pick-up station.

8. The labelling apparatus of claim 7 wherein said turret has a plenum for communicating a vacuum to sad tamping bead at said label pick-up station.

9. The labelling apparatus of claim 8 wherein each of said tamping labellers comprises a flexible bellows.

10. A labelling apparatus comprising:

a turret carrying a plurality of tamping labellers;

a protuberanced wheel having at least one protuberance;

an intermittent drive for intermittently driving said turret and said protuberanced wheel;

a slotted wheel driven by said protuberanced wheel, said slotted wheel for driving a label web for feeding labels to said tamping labellers; and a sensor for sensing a position marker on said protuberanced wheel.

11. The labelling apparatus of claim 10 wherein said position marker comprises said at least one protuberance.

12. The labelling apparatus of claim 9 further comprising a pair of driven nip rollers downstream of said label pick-up station for tensioning said label web.

13. The labelling apparatus of claim 11 further comprising a right angled label cassette locating corner facing a first direction and a sloped, label cassette urging surface facing an opposite direction for urging a label cassette into abutment with said label cassette locating corner.

14. The labelling apparatus of claim 13 further comprising a label cassette initial locating pin, said locating corner being between said initial locating pin and said urging surface.

15. The labelling apparatus of claim 14 wherein said label immediately upstream of said tongue end lies in a plane that makes an angle of about 140 degrees with said label pick-up face of said tamping head of said one of said tamping labellers positioned at said pick-up station.

16. A labelling apparatus comprising:

a turret carrying a plurality of flexible tamping bellows;

a protuberanced wheel including a pin extending outwardly from said protuberanced wheel in a direction parallel to an axis of rotation of said protuberanced wheel, said pin fixed in position on said protuberanced wheel;

an intermittent drive for intermittently driving said turret and said protuberanced wheel;

a label web for feeding labels to said tamping labellers; and a slotted wheel defining a slot receiving said pin, said slotted wheel discontinuously driven by said protuberanced wheel, said slotted wheel driving said label web.

17. The labelling apparatus of claim 16 wherein said label web has pin holes and wherein said slotted wheel has pins.

18. A product labelling apparatus, comprising:

a stationary cylindrical core;

a rotatable annular sleeve carried on said core;

a flexible bellows carried by said rotatable annular sleeve, said bellows having a retracted position and an extended tamping position;

said stationary cylindrical core having a first airway for communicating a negative air pressure to said bellows in order to retract said bellows to said retracted position and a second airway for communicating a positive pressure to said bellows in order to extend said bellows, said first airway comprising a channel extending continuously along a substantial portion of a periphery of said stationary core, said second airway comprising a slot in said periphery of said stationary core spaced Item either end of said channel by a land; and an air diffuser associated with said bellows, said air diffuser extending interiorly of said bellows from a base of said bellows toward a tamping end of said bellows, said first airway for communicating said negative air pressure to said bellows through said air diffuser and said second airway for communicating said positive air pressure to said bellows through said air diffuser.

19. The labelling apparatus of claim. 18 wherein said tamping end of said bellows has perforations such that when said negative air pressure is communicated to said bellows, there is a negative pressure in a vicinity of said tamping end of said bellows for holding a label on said tamping end.

20. A product labelling apparatus comprising:

at least one flexible bellows having a base, a tamping end, and a side extending between said base and said tamping end, said bellows movable between a retracted position and an extended tamping position;

an air diffuser associated with each bellows, each air diffuser extending interiorly of an associated bellows from said base of said associated bellows toward said tamping end of said associated bellows, said each air diffuser having a central opening facing said tamping end of said associated bellows and at least one side opening facing said side of said associated bellows; and an air blocking member associated with said associated bellows for blocking said central opening of said each air diffuser when said associated bellows is in said retracted position, said tamping end of each said bellows being perforated, said air blocking member comprising a one-way valve at said tamping end of each said bellows, said one-way valve closing in the presence of positive pressure air from said air diffuser and opening in the presence of negative pressure air from said air diffuser.

* * * * *

UNITED STATES PATENT AND TRADEMARK OFFICE

CERTIFICATE OF CORRECTION

PATENT NO. : 7,178,574 B2
APPLICATION NO. : 10/472361
DATED : February 20, 2007
INVENTOR(S) : Nielsen et al.

It is certified that error appears in the above-identified patent and that said Letters Patent is hereby corrected as shown below:

Column 11, Claim 8, Line 32:
"sad" should be -- said --.

Column 11, Claim 8, Line 33:
"bead" should be -- head --.

Column 12, Claim 18, Line 29:
"Item" should be -- from --.

Signed and Sealed this

Thirty-first Day of July, 2007

JON W. DUDAS
*Director of the United States Patent and Trademark Office*